United States Patent [19]

Spiers

[11] Patent Number: 4,860,646

[45] Date of Patent: Aug. 29, 1989

[54] COMPACTOR WITH HYDRAULIC DWELL AND METHOD

[75] Inventor: Kent Spiers, Caledonia, Miss.

[73] Assignee: Marathon Corporation, Birmingham, Ala.

[21] Appl. No.: 13,079

[22] Filed: Feb. 10, 1987

[51] Int. Cl.[4] ..... B30B 15/18; B30B 15/22; F15B 11/15; F15B 15/22

[52] U.S. Cl. ..... 100/48; 100/269 R; 60/377; 91/39; 91/219; 91/355; 91/401; 91/422

[58] Field of Search ..... 91/35, 49, 50, 219, 91/222, 224, 229, 341, 342, 348, 355, 356, 401, 410, 422, 399, 23, 404, 39, 405; 60/376, 377, 477; 100/48, 269 R

[56] References Cited

U.S. PATENT DOCUMENTS

| | | | |
|---|---|---|---|
| 239,493 | 3/1881 | Haskin | 91/224 X |
| 2,219,896 | 10/1940 | Harrington et al. | 60/52 |
| 2,250,705 | 7/1941 | Ernst | 60/377 |
| 2,356,423 | 8/1944 | O'Leary | 91/49 X |
| 2,388,716 | 11/1945 | Svenson | 91/355 X |
| 2,552,634 | 5/1951 | Kerr | 91/355 |
| 2,976,878 | 3/1961 | Smilges | 60/377 X |
| 3,046,951 | 7/1962 | Freeborn | 121/150 |
| 3,169,450 | 11/1965 | Kohl | 91/28 |
| 3,311,026 | 3/1967 | Crisp | 91/422 X |
| 3,352,322 | 11/1967 | Strick | 91/355 X |
| 3,448,658 | 6/1969 | Arnes | 91/401 X |
| 3,469,861 | 9/1969 | Schexnayder | 91/401 X |
| 3,534,679 | 10/1970 | Fonichon | 100/52 |
| 3,592,217 | 7/1971 | Keagle | 137/115 |
| 3,654,834 | 4/1972 | Sifri et al. | 91/422 X |
| 3,785,278 | 1/1974 | Hopkins | 100/229 A X |
| 3,793,945 | 2/1974 | Nolvak | 100/257 |
| 3,875,746 | 4/1975 | Elliott | 60/477 X |
| 4,002,103 | 1/1977 | Martin | 91/219 |
| 4,022,096 | 5/1977 | Forichon | 83/617 |
| 4,029,456 | 6/1977 | Ahrweiler | 425/149 |
| 4,068,561 | 1/1978 | Fay | 91/433 |
| 4,248,260 | 2/1981 | Addison et al. | 91/39 X |
| 4,275,793 | 6/1981 | Schivleg, Jr. et al. | 173/9 |
| 4,286,929 | 9/1981 | Heath et al. | 91/224 X |
| 4,337,687 | 7/1982 | Hoover | 91/401 |
| 4,339,843 | 7/1982 | Burnett, Jr. | 16/62 |
| 4,373,425 | 2/1983 | Moatti | 91/229 X |
| 4,603,625 | 8/1986 | Brown | 100/229 A X |
| 4,648,307 | 3/1987 | Rabe | 91/401 X |

FOREIGN PATENT DOCUMENTS

| | | | |
|---|---|---|---|
| 1961391 | 6/1971 | Fed. Rep. of Germany | 60/477 |
| 1040238 | 9/1983 | U.S.S.R. | 91/401 |

*Primary Examiner*—Robert E. Garrett
*Assistant Examiner*—George Kapsalas
*Attorney, Agent, or Firm*—Shlesinger & Myers

[57] ABSTRACT

A compactor includes a longitudinally extending ground supported frame having an open end and a closed end. A cylinder and piston assembly is positioned within the frame and extends longitudinally therealong and a ram is secured to the piston for transferring waste through the open end. The cylinder has fluid ports at opposite ends thereof. An hydraulic fluid supply assembly introduces pressurized fluid to said ports for causing selective movement of the piston relative to the cylinder. An hydraulic spool valve is carried by the piston for permitting fluid to flow between the ports and for thereby preventing displacement of the piston when the dwell assembly engages one of the ends.

14 Claims, 3 Drawing Sheets

COMPACTOR WITH HYDRAULIC DWELL AND METHOD

BACKGROUND OF THE INVENTION

A compactor is an hydraulically operated device which compresses waste in order to reduce the handling and disposal costs thereof. A conventional compactor uses an hydraulically movable ram for transferring the waste from a charge box into a compactor container wherein the waste is compressed. Frequently, there is sufficient waste for several charges to be placed sequentially into the charge box, with the result that the ram must reciprocate a sufficient number of times to transfer and compress all waste.

Repetitive reciprocation of an hydraulic cylinder and piston assembly is best carried out with the assistance of a sensing mechanism for determining when the piston has reached the end of the stroke in either direction. The prior art discloses the use of pressure sensors and electrical sensors for making this determination. The pressure sensor can determine when the piston has bottomed out because the pressure in the hydraulic system increases due to the inability of the piston to move. Pressure sensing is not desirable, however, because the system must first reach a preset pressure in excess of the operating pressure upon the completion of each stroke and this pressure may cause damage and/or wear, particularly over an extended use period. An electrical sensing system, on the other hand, normally utilizes a limit switch, a proximity switch or a magnetic switch. These switches open or close electrical circuits which cause the system to stop or to activate solenoid valves for directing fluid flow. Electrical switches are not normally suitable for compactors, however, because the cylinder and piston assembly is normally located in a relatively harsh environment and these switches, by nature of their operation, must be located within that environment.

Electrical timers have also been used to control automatic cylinder motion, particularly in one direction only. A timer mechanism, however, does not provide a positive indication of cylinder or piston position. Cylinder position can only be approximated with a timer by oversetting the timer in order to be almost absolutely sure that the piston has bottomed out. The timer mechanism, therefore, is not normally desirable because, once again, the piston must bottom out and because excess time is required for each completion of cycle.

From the above, it can be seen that there is a need for a device permitting the piston to bottom out in the cylinder without causing excessive pressure, wear or increased operating time. Such a system should not be subject to contamination or deterioration by the harsh compactor environment.

SUMMARY OF THE INVENTION

The primary object of the disclosed invention is an hydraulic dwell assembly permitting the movable piston of the hydraulically operated cylinder and piston assembly to bottom out while avoiding the excessive pressure, contact and time delay problems of the prior art. The hydraulic dwell of the invention utilizes a system of mechanical and electrical timing devices for reversing or stopping piston motion at the limit of the stroke. An hydraulic spool is carried by the piston and is movable therewith and is mechanically shifted upon contact with the ends of the cylinder as the end of the stroke approaches. Shifting of the spool permits fluid to bypass, or flow through the piston, with a relatively low pressure drop. The bypass of fluid allows the hydraulic system and the piston to idle while a conventional electrical timer times out and/or shifts the direction of fluid flow.

While the disclosed invention is advantageously utilized with an hydraulically operated compactor, those skilled in the art will appreciate that the idler or hydraulic dwell of the invention can be utilized in essentially any cylinder and piston assembly requiring repetitive reciprocation. Similarly, while the invention is advantageously described as being used with an hydraulic fluid medium, the invention can be practiced with other sorts of fluid media, such as air, gas, water, and the like.

The idler of the invention comprises a cylinder including first and second ends and first and second fluid ports, each of the ports being proximate one of the ends. A piston is slidably positioned in the cylinder and the piston is selectively movable between the ends in response to pressurized fluid being introduced at the ports. An aperture extends longitudinally through the piston disk and a spool is slidably received therein. The spool includes a reduced diameter dwell portion disposed between larger diameter land areas. The spool is selectively movable with the piston and each of the land portions extends beyond the piston and toward one of the associated ends. The piston includes first and second ports, each of which is in fluid communication with an associated cylinder port. The piston ports also have a portion communicating with the aperture in the piston. Displacement of the piston causes corresponding displacement of the spool because a land area blocks the associated piston port. Eventually, one of the land portions engages the associated end and thereby permits displacement of the piston relative to the spool until the dwell portion becomes aligned with the piston ports, and thereby permits fluid flow between the cylinder ports.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
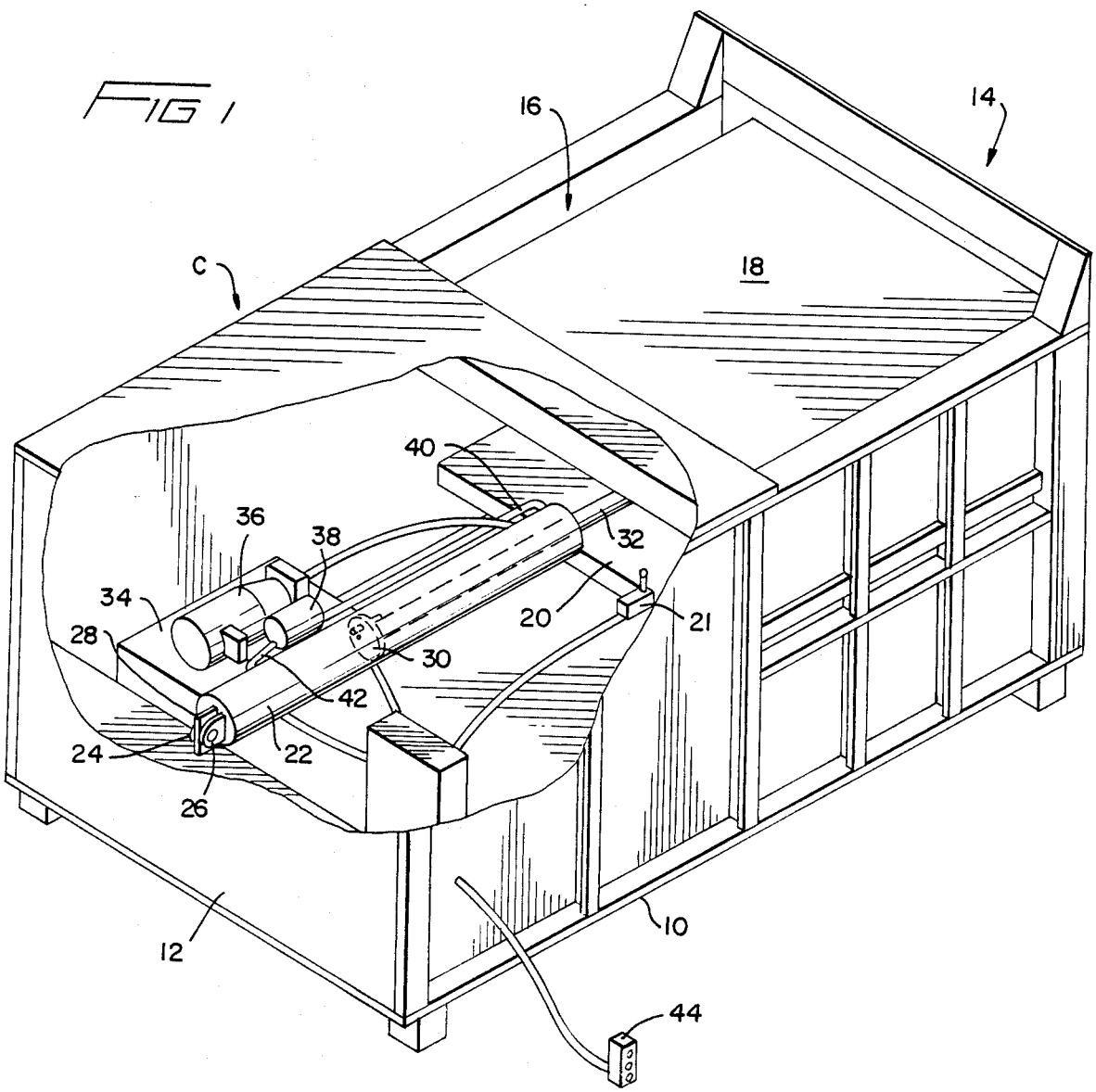
FIG. 1 is a perspective view with portions broken away and with portions shown in phantom disclosing the compactor and hydraulic dwell of the invention.

Compactor C, as best shown in FIG. 1, includes a ground supported longitudinally extending frame 10. Frame 10 has a first closed end 12 and a second oppositely disposed open end 14. The open end 14 of the frame 10 is, preferably, releaseably connected to a compactor container (not shown) having a corresponding opening for permitting waste to be transferred from the compactor C to the container (not shown).

Compactor C has a charge box 16 into which the waste is placed to permit transfer thereof into the container (not shown). Compactor ram 18 is longitudinally movable along frame 10 for opening the charge box 16 to permit waste to be placed therein and to be transferred therefrom through the opening 14. Preferably, the ram 18 has a portion which slides along table 20 extending along the bottom of frame 10 and engageable with switch 21. The ram 18 also has a top valve means for controlling flow of waste into the charge box 16.

Cylinder 22 is pivotally connected by ears 24 and 26 to brace 28 secured to closed end 12. Those skilled in the art will understand that the cylinder 22 is, preferably, centrally disposed within frame 10 and extends longitudinally therealong. Piston 30 is slidably received within cylinder 22 and piston rod 32 extends therefrom and is connected at the distal end to ram 18.

Container C includes an hydraulic fluid reservoir 34 from which motor driven pump 36 extracts hydraulic fluid. Directional control valve assembly 38 is in fluid communication with the output of pump 36 and causes pressurized hydraulic fluid to be directed through lines 40 and 42 to the opposite ends of the cylinder 22. Those skilled in the art will understand that introduction of pressurized fluid into the cylinder 22 causes the piston 30, as well as the piston rod 32 thereof, to be selectively displaced in response to the fluid pressure differential across the piston 30. FIG. 1 also illustrates the operator controls 44 which are in electrical connection with the pump 36 and the directional valve 38 for causing operation of the compactor C.

Figure 2:
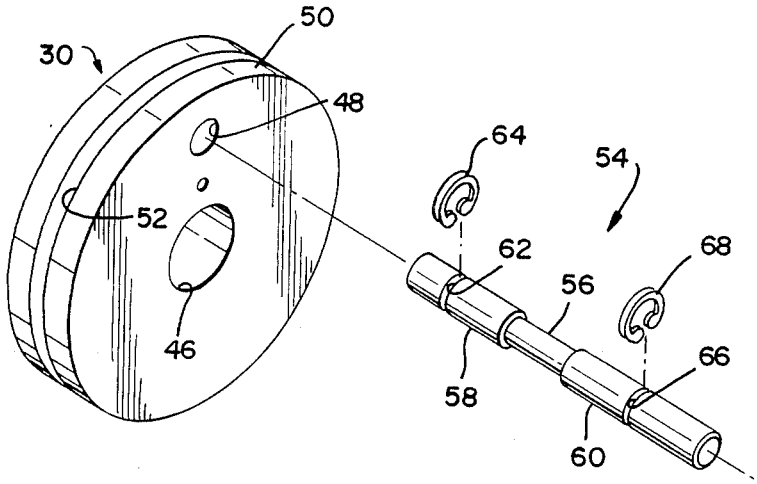
FIG. 2 is a perspective assembly drawing of the hydraulic dwell of the invention.

The piston 30, as best shown in FIG. 2, has a central aperture 46 therethrough which receives the piston rod 32. Piston 30 also includes another aperture 48 therethrough which extends parallel to the aperture 46 but which is proximate the peripheral surface 50 of the piston 30. A groove 52 extends around the surface 50 of piston 30, for reasons to be further explained.

Spool assembly 54, as best shown in FIG. 2, is slidably positioned within the aperture 48 of the piston disk 30. Spool assembly 54 has a reduced diameter dwell portion 56 disposed between larger diameter land portions 58 and 60. Land portion 58 has a groove 62 thereabout in which retainer ring 64 is removably positioned. Likewise, land portion 60 has a groove 66 thereabout which receives retainer ring 68. Preferably, the land portions 58 and 60 have a uniform diameter, which diameter is continuous over the respective lengths of the land portions 58 and 60.

Figure 3:
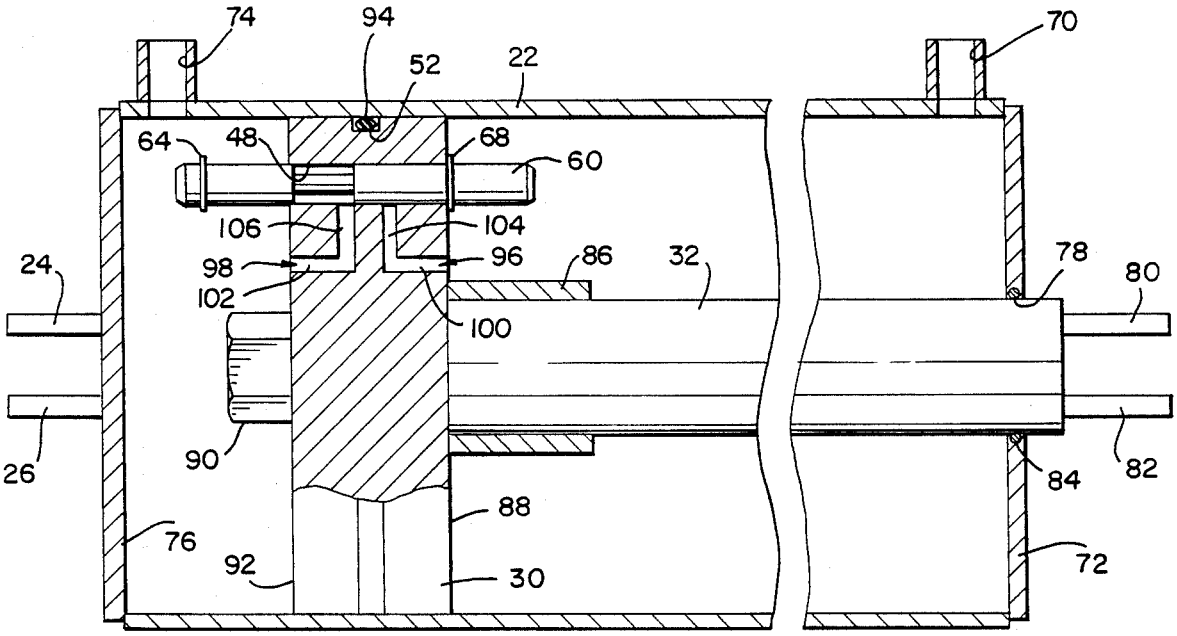
FIG. 3 is a fragmentary cross-sectional view disclosing the hydraulic dwell of the invention during movement of the piston.

Cylinder 22, as best shown in FIG. 3, has a first fluid port 70 proximate the end 72 thereof. A corresponding fluid port 74 is disposed at the opposite end 76 thereof adjacent the ears 24 and 26. Those skilled in the art will understand that the ports 70 and 74 are in fluid communication with the hydraulic lines 40 and 42, respectively, by suitable connectors. In this way, hydraulic fluid can be introduced into and withdrawn from the cylinder 22 for selectively displacing the piston 30 between the ends 72 and 76. Piston rod 32 extends through an aperture 78 in end 72. Ears 80 and 82 extend from rod 32 and pivotally connect ram 18 to the rod 32. Naturally, the aperture 78 has a seal 84 for preventing hydraulic fluid from leaking from cylinder 22.

Spacer tube 86 is mounted to the rod 32, at one end thereof, and is engaged with the surface 88 of piston 30. Rod nut 90 secures the piston 30 to the end of piston rod 32 and is engaged with the opposite parallel surface 92 of the piston 30. Also to be noted in FIG. 3 is the O-ring 94 positioned within the groove 52.

FIG. 3 discloses L-shaped port 96 which extends through the surface 88 and which communicates with the aperture 48. The oppositely disposed but aligned port 98, on the other hand, extends through the surface 92 and likewise communicates with the aperture 48. It can be noted that the ports 96 and 98 each have a duct portion 100 and 102, respectively, which extends coaxially parallel to the axis of rod 32. Similarly, each of the ports 96 and 98 has a duct portion 104 and 106, respectively, which extends generally transverse to the axis of rod 32. While the ports 96 and 98 are shown as being L-shaped, those skilled in the art will appreciate that other configurations are possible.

The port 96 is in fluid communication with the port 70, while the port 98 is in fluid communication with the port 74. The ports 96 and 98 are, preferably, appropriately sized so as to accommodate a substantial portion, if not all, of the output volume of the positive displacement pump 36.

FIG. 3 illustrates the spool assembly 54 as the piston 30 is being displaced toward the end 76. This displacement occurs because pressurized hydraulic fluid is introduced through port 70 as fluid is removed through the port 74. Naturally, the introduction and removal of the hydraulic fluid is accomplished by suitable valves and the like. Because of the resulting pressure differential across the piston 30, the piston 30 slides to the left, as viewed in FIG. 3, and thereby causes the piston rod 32 to be likewise moved. The result is that the ram 18 is caused to move so as to open the charge box 16 to permit another load of waste to be placed therein.

The spool assembly 54, in the configuration illustrated in FIG. 3, is acted on by the hydraulic fluid introduced through the port 70 in a manner similar to piston 30. The pressure differential across the spool assembly 54 causes the spool assembly 54 to slide within the aperture 48 toward the left, as viewed in FIG. 3. The land portion 60 blocks the port 96 because ring 68 engages surface 88 and prevents further movement of spool assembly 54 and thereby prevents hydraulic fluid from flowing through the port 96. The result is that the fluid does not bleed through the port 96 and thereby permits the piston 30 to continue to move toward the end 76.

Figure 4:
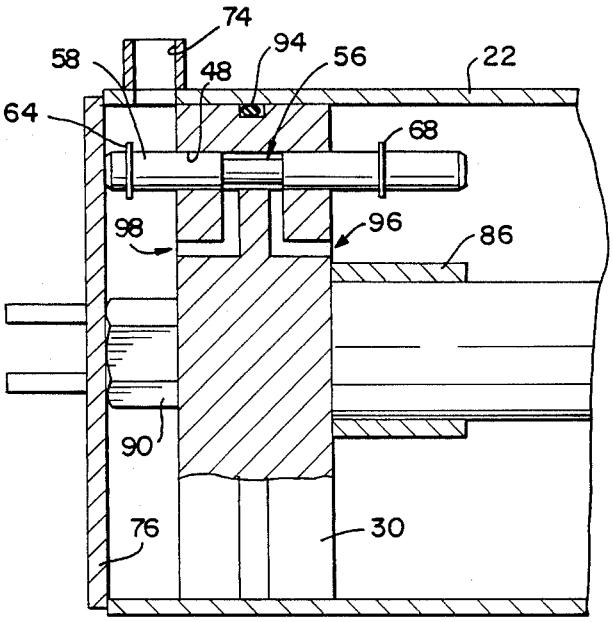
FIG. 4 is a fragmentary cross-sectional view illustrating the hydraulic dwell of the invention in the idle configuration.

FIG. 4 illustrates the position that the piston 30 achieves upon the land portion 58 engaging the end 76. The spool assembly 54 is slidably positioned within the aperture 48 so that the piston 30 may move relative to the spool assembly 54 upon the land portion 58 engaging the end 76 and being thereby prevented from further movement. The result is that the piston 30 continues to move toward the end 76, although the spool assembly 54 can no longer move. Eventually, the dwell portion 56 becomes aligned with the port portions 104 and 106 and thereby permits hydraulic fluid to flow through the ports 96 and 98. Therefore, hydraulic fluid introduced through the port 70 is now permitted to flow through the ports 96 and 98 by means of the dwell portion 56 to the outlet 74. This bypass flow condition has the effect of stopping the displacement of the piston 30 or, depending upon the sizing of the ports 96 and 98, substantially reducing the pressure differential across the piston 30 and thereby the force applied by the hydraulic fluid. Because of this reduced pressure differential, there is a greatly reduced possibility of the rod nut 90 damaging the cylinder 22. Furthermore, because of the reduced system pressure when compared with that conventionally attained at the end of the stroke, the hydraulic system is not subject to the damage and other problems that were previously possible.

FIG. 4 also illustrates that the rod nut 90 may engage the end 76 of the cylinder 22 without causing damage thereto. Also to be noted in FIG. 4 is the fact that the spool assembly 54 has a length corresponding to the combined length of the rod nut 90 and the spacer tube 86 as well as the thickness of the piston 30. It is important to make sure that the land portions 58 and 60 extend from the dwell portion 56 a distance sufficient to permit contact by the associated piston dwell element with the respective end.

Figure 5:
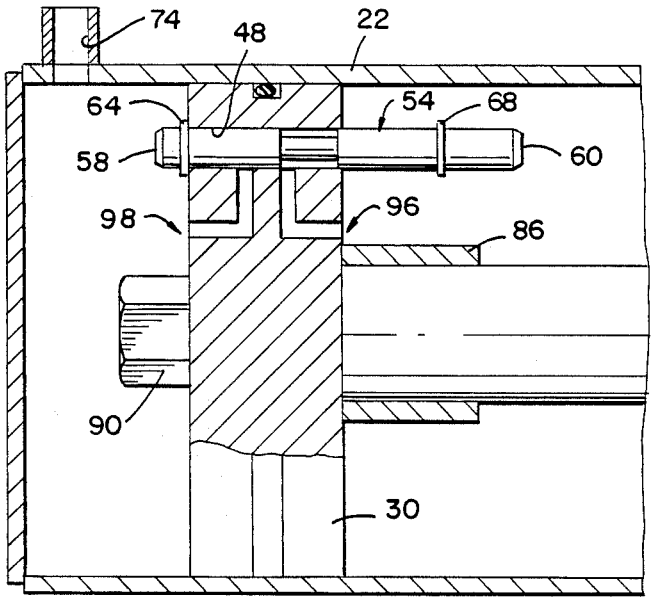
FIG. 5 is another fragmentary cross-sectional view illustrating the hydraulic dwell of the invention during movement of the piston opposite to the direction of FIG. 3; and, FIG. 6 is a schematic diagram illustrating the hydraulic circuit used with the compactor and dwell of FIG. 1.

FIG. 5 illustrates the piston 30 as it is being displaced toward the end 72. Those skilled in the art understand that the application of hydraulic pressure through the port 74 while bleeding fluid through the port 70 will have the effect of creating the necessary pressure conditions for causing displacement of the piston 30 toward the end 72. Application of hydraulic pressure through port 74 likewise causes a pressure drop through the aperture 48 of an amount sufficient to assure displacement of the spool assembly 54 toward the right, as viewed in FIG. 5. In this position, the land portion 58 blocks the port 98 and prevents the fluid from bypassing through the ports 96 and 98.

Although not illustrated in FIG. 5, those skilled in the art will understand that the land portion 60 will engage the end 72 upon suitable displacement of the piston 30. As when the land portion 58 engaged the end 76, then the spool assembly 54 will be prevented from moving. Once again, the piston 30 will be able to move relative to the spool assembly 54 until such time as the dwell portion 56 aligns with the port portions 104 and 106. Alignment of the dwell portion 56 with the ports 96 and 98 will once again permit fluid to bypass through the ports 96 and 98 by means of the dwell portion 56 and thereby stop further movement of the piston 30, or substantially decrease the pressure differential thereacross and the force applied thereto. As previously explained, the land portion 60 extends from the dwell portion 56 a distance sufficient to prevent excessive contact of the end 72 by the spacer tube 86.

It can be noted in FIGS. 3 and 5 that the retainer rings 64 and 68 prevent excessive displacement of the spool assembly 54 within the aperture 48 by acting as positive mechanical stops. The retainer rings 64 and 68 thereby prevent the spool assembly 54 from being expelled from the aperture 48 and permitting fluid to bypass in an uncontrolled way through the piston 30.

Figure 6:
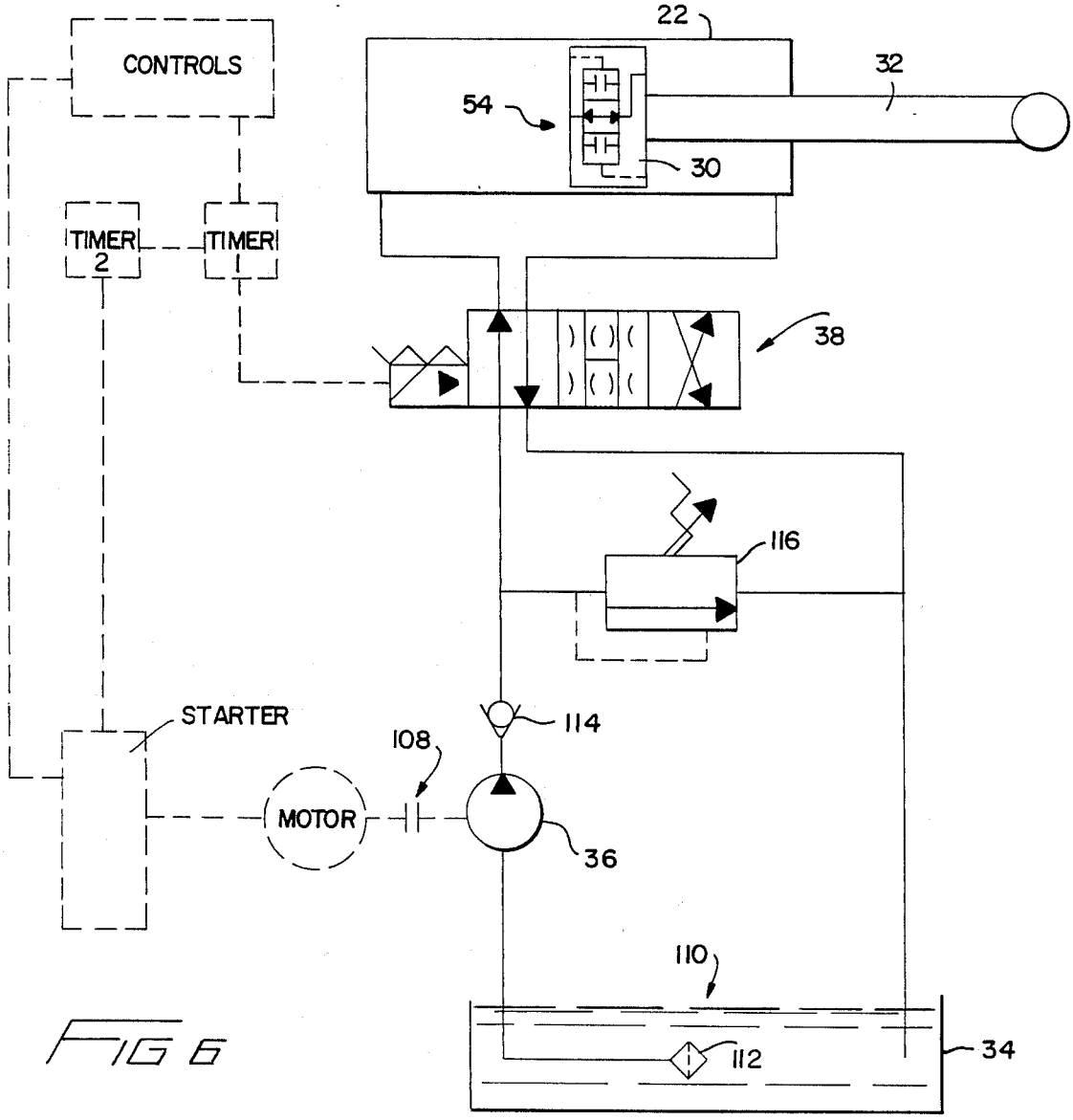

FIG. 6 illustrates, in schematic form, the hydraulic circuit used to operate the container C with the dwell of the invention. The controls are activated to cause the motor starter contacts to close. This causes the motor to run, the pump 36 to generate pressurized fluid flow and the piston rod 32 to be extended; that is, shifted toward the right as viewed in FIG. 3. Activation of the motor starter also causes Timer 1 to begin operation.

The motor is connected to pump 36 by means of hub coupling 108. Pump 36 extracts hydraulic fluid 110 from the reservoir 34 through filter 112. Pump 36 pumps the pressurized hydraulic fluid through check valve 114 to directional control valve 38. Preferably, the directional control valve is a two position 4-way solenoid valve, of a type well known in the art, although other valves and directional control assemblies are known. Also in line with the pump 36 is a pressure relief valve 116.

When Timer 1 times out, then its contacts close and cause the directional control valve 38 to shift, and thereby reverse the fluid flow to the cylinder 22. In other words, the fluid is now directed through the port 70 as fluid is withdrawn through the port 74.

Timing out of Timer 1 causes the activation of Timer 2. When Timer 2 times out, then its contacts open causing the motor starter contacts to close. Closing of the motor starter contacts causes the motor to stop. Preferably, Timer 1 is set for a period of time slightly greater than that required for the piston 30 to complete its stroke to end 72. Likewise, Timer 2 is set for a period of time slightly greater than that required for the cylinder 30 to complete its traverse to end 76. Timers 1 and 2 have a slightly greater time than is necessary because this assures that the piston 30 has reached the associated end. Because of the spool assembly 54, there is no concern that excessive pressure will build up and cause damage to the hydraulic system, or damage to the cylinder 22 itself.

There are several possible variations of the control system illustrated in FIG. 6. For example, only 1 timer need be used for shifting and shutting down the system. However, in this variation the system will idle for a period of time at the end of its cycle, depending upon the piston rod size. It is also feasible to include pressure switches and the like, for shutting down the system in the event of excessive waste accumulation in the container, such as could prevent displacement of the piston 30.

The machined spool assembly 54 is slidably positioned within the aperture 48 in the piston 30 of the hydraulic cylinder 22 with a tight machine fit between the spool assembly 54 and piston 30. The spool assembly 54 extends through the piston 30 and has retaining rings 64 and 68 for limiting its displacement within the aperture 48. The spool assembly 54 furthermore has a dwell portion 56 for permitting fluid passage through the cylinder cavity by means of the dwell portion 56. The spool assembly 54 is so machined with the dwell portion 56 that, when aligned with the ports 96 and 98 in the piston 30, then the fluid may flow through the piston 30 with limited pressure loss. Essentially then, the cylinder resembles a conduit.

The spool assembly 54 is so designed that the hydraulic fluid passes through the piston 30 only when the spool assembly 54 is in its "centered" position. When the spool assembly 54 is shifted to its extreme position in either direction, then one of the ports 96 and 98 is blocked by the respective land portion 60 and 58 with the result that the hydraulic fluid cannot pass through the piston 30.

When the pressurized fluid enters the double acting hydraulic cylinder 22 through one of the ports 70 and 74, then the pressure differential forces the spool assembly 54 to shift to its extreme position in the direction of piston 30 travel. This shift blocks the fluid flow through the piston 30 and thereby permits the piston 30 to travel in the normal manner. If fluid flow is reversed, then the spool assembly 54 shifts to its opposite extreme position, thereby effecting normal piston motion in the opposite direction.

Upon the piston 30 approaching the end of its stroke, then the spool assembly 54 strikes one of the ends of the cylinder 22, thereby causing the spool assembly 54 to shift to its centered position. This configuration allows the fluid to bypass through the piston 30 with low pressure loss until the timing device "times out" and reverses the fluid flow or shuts down the hydraulic unit. The spool assembly 54 remains in this centered position until the fluid flow reverses, thereby causing the spool assembly 54 to shift and the piston 30 to move in the reverse direction.

While this invention has been described as having a preferred design, it is understood that it is capable of further modifications, uses and/or adaptations of the invention following in general the principle of the invention and including such departures from the present disclosure has come within known or customary practice in the art to which the invention pertains, and as may be applied to the central features hereinbefore set forth, and fall within the scope of the invention of the limits of the appended claims.

What I claim is:

1. A compactor, comprising:

(a) a longitudinally extending ground supported frame assembly with an open end and a closed end;

(b) an hydraulic motor means including a cylinder means and piston means, said motor means having one of said cylinder means and piston means connected with said closed end and said motor means extending longitudinally toward said open end;

(c) a compactor ram connected with the other one of said cylinder means and piston means for transferring waste through said open end and said other one of said cylinder means and piston means being movable relative to said one of said cylinder means and piston means;

(d) said cylinder means including first and second fluid ports at opposite first and second ends thereof;

(e) hydraulic fluid supply means are in fluid communication with said ports for directing pressurized fluid therebetween for causing selective movement of said other one of said cylinder means and piston means and thereby of said ram;

(f) hydraulic dwell means carried by said piston means for permitting fluid to flow between said ports for preventing displacement of said other one of said cylinder means and piston means when said dwell means engages one of said cylinder ends;

(g) said dwell means including a spool assembly displaceable with and selectively displaceable relative to said piston means and including a dwell portion disposed between first and second land portions, each of said land portions engageable with an associated one of said cylinder means ends for permitting relative displacement of said dwell means with said piston means;

(h) said piston means including fluid port means communicable with said dwell portion when one of said land means engages one of said cylinder means ends for permitting fluid to flow between said ports and through said dwell portion;

(i) a continuous diameter aperture extends through said piston means;

(j) said dwell means is positioned within said aperture and said land portions have a common continuous diameter substantially equal to said aperture diameter;

(k) said aperture extends generally parallel to said cylinder means; and, (l) first and second fluid ducts are disposed in said piston means, each duct has a first opening in a wall of said piston means and a second opening communicating with said aperture for permitting fluid flow to be selectively established between said ports.

2. The compactor of claim 1, wherein:

(a) directional flow valve means being in fluid communication with said ports and with said fluid supply means for directing fluid between said ports; and, (b) means being operably associated with said valve means for shifting said valve means and for thereby causing fluid flow to be directed from a first one to a second one of said ports.

3. The compactor of claim 2, wherein:

(a) said shifting means including timer means for shifting said valve means when a preselected period has elapsed.

4. The compactor of claim 2, wherein:

(a) said valve means including a solenoid.

5. The compactor of claim 1, wherein:

(a) a peripheral groove is disposed in said piston means and between said second openings; and, (b) seal means are positioned in said groove.

6. The compactor of claim 1, further comprising:

(a) timer means operably associated with said cylinder means for causing the direction of travel of said other one of said cylinder means and piston means to be reversed after said dwell means has engaged a cylinder end.

7. The compactor of claim 1, wherein:

(a) distance limiting means being carried by each of said land portions for controlling displacement of said dwell means relative to said piston means.

8. The compactor of claim 7, wherein:

(a) a groove extending about each of said land portions;

(b) a retainer ring being mounted in each of said grooves, each of said rings being engageable with said piston means for limiting displacement of said dwell means; and, (c) each of said land portions extending longitudinally beyond the associated rings.

9. The compactor of claim 1, wherein:

(a) said piston means including a piston slidably disposed within said cylinder means and a piston rod extending therefrom and secured to said ram; and, (b) said spool assembly extending parallel to said piston rod.

10. The compactor of claim 9, wherein:

(a) an aperture extending through said piston parallel to said rod;

(b) said spool means slidably positioned within said aperture and each of said land means portions extending therefrom beyond said piston; and, (c) said fluid port means including first and second ducts, each of said ducts in fluid communication with one of said ports and one of said ducts being blocked by a land portion while said piston means is being displaced in the direction of the other of said land portions and thereby preventing fluid flow between said ports.

11. The compactor of claim 9, wherein:

(a) a spacer tube being mounted to said piston rod and engaged with said piston along a first surface thereof;

(b) a rod nut securing said piston to said piston rod and being engaged with said piston along a second surface thereof; and, (c) said dwell means having a length corresponding to the combined distance of said rod nut and said spacer tube when said piston is clamped therebetween.

12. The compactor of claim 1, wherein:

(a) each duct has a first portion extending generally parallel to said cylinder means and a second portion extending generally transverse thereto.

13. The compactor of claim 12, wherein:

(a) said first duct first opening is associated with the associated first portion and said second duct second opening is associated with the associated second portion.

14. The compactor of claim 12, wherein:

(a) each duct second portion extends from said aperture.

* * * * *